United States Patent [19]

Mandel

[11] Patent Number: 4,805,777

[45] Date of Patent: Feb. 21, 1989

[54] MATERIAL HANDLING ARRANGEMENT

[76] Inventor: Ronald L. Mandel, 9115 Old State Rd., Evansville, Ind. 47711

[21] Appl. No.: 645,503

[22] Filed: Aug. 30, 1984

[51] Int. Cl.[4] ..... B65D 85/04

[52] U.S. Cl. ..... 206/597; 108/55.1

[58] Field of Search ..... 206/597, 303, 389, 394, 206/397; 108/51.3, 52.1, 55.1, 55.3, 55.5; 248/310

[56] References Cited

U.S. PATENT DOCUMENTS

| | | | |
|---|---|---|---|
| 2,160,235 | 5/1939 | Slusar | 206/303 |
| 3,104,085 | 9/1963 | Skladany | 206/597 X |
| 3,524,415 | 8/1970 | Heiman | 108/55.1 X |
| 3,695,187 | 10/1972 | Weiss | 108/55.5 |
| 3,858,723 | 1/1975 | Weiss | 206/303 X |
| 3,908,850 | 9/1975 | Jureit et al. | 206/597 X |
| 4,099,617 | 7/1978 | Nist, Jr. | 206/597 X |
| 4,257,523 | 3/1981 | Blasio | 206/303 |
| 4,317,517 | 3/1982 | Tisdale | 206/597 |

*Primary Examiner*—Steven M. Pollard

*Attorney, Agent, or Firm*—Warren D. Flackbert

[57] ABSTRACT

A material handling arrangement characterized as a grouping of individual stock receiving blocks which positively position the stock against unwanted movement when being transported by either a forklift truck, a sheet edge lifter, or other moving mechanisms, where such blocks, serving as a replacement for a conventional wooden pallet, are durable, lightweight and conveniently stacked for storage. Provision is made for the ready securing of the stock onto each of the blocks.

5 Claims, 2 Drawing Sheets

MATERIAL HANDLING ARRANGEMENT

As is known, the handling of material, such as rolled steel stock, is a significant factor in any manufacturing operation. Conventionally, the material is placed on wooden pallets and moved by means of a forklift truck from a receiving area to a storage area and then on to a use site. One difficulty encountered with pallet usage is in the costly replacement of such due to wear and/or damage, representing a reoccuring expense to the operator.

The invention overcomes the preceding problem by presenting a material handling arrangement characterized, in two forms, by blocks which, when arranged, selectively receive and secure the material under transport for movement by either a forklift truck, a sheet lifter, or other transfer mechanisms. Preferably, the blocks are fabricated from a high impact dense plastic resin, serving durability and, therefore, longer usage than the known wooden pallets. Moreover, the blocks are interchangeable; individually replaceable, if necessary; and, representative of relatively small space or storage area requirements and, in this connection, are readily stacked while awaiting use.

In any event, a better understanding of the present invention will become more apparent from the following description, taken in conjunction with the accompanying drawing, wherein FIG. 1 is a top plan view, partly fragmentary, showing one form of material handling arrangement in accordance with the teachings of the present invention in a use condition;

Figure 1:
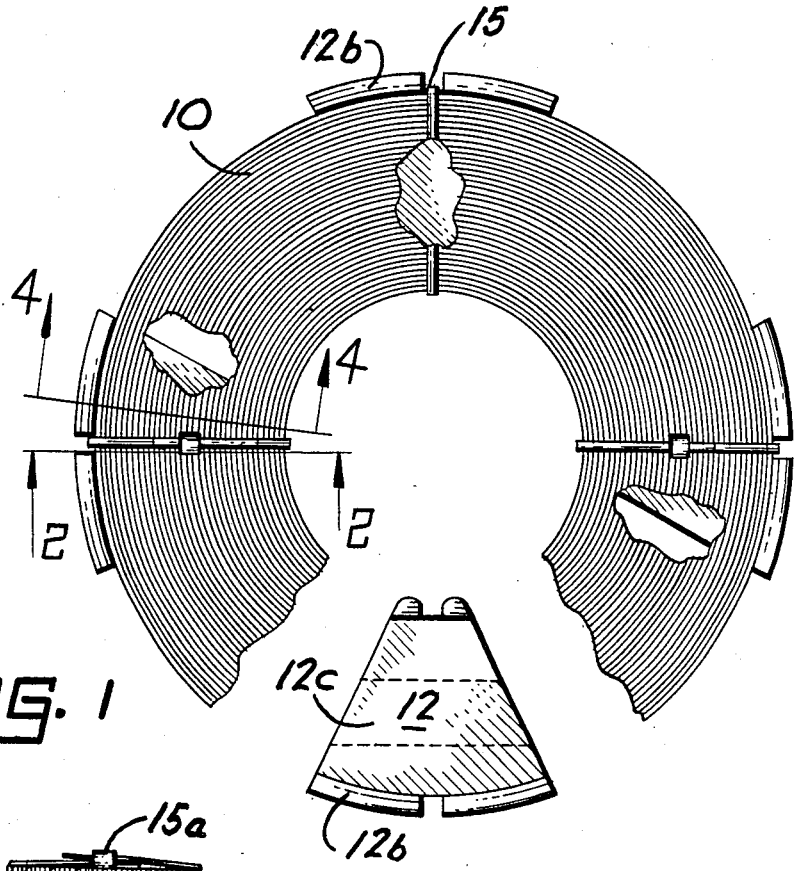

For the purposes of promoting an understanding of the principles of the invention, reference will now be made to the embodiments illustrated in the drawing and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Referring now to FIGS. 1 to 4, inclusive, one form of material handling arrangement presented by the invention, shown in a typical use condition with a coil of rolled steel stock 10, includes four independent blocks

12, each made from a high impact plastic resin, die cast aluminum or the like and representative of a segment of a toroid.

Figure 3:
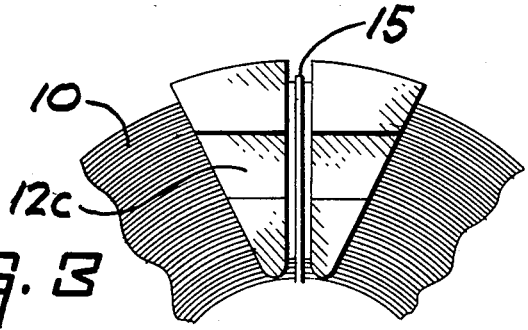
FIG. 3 is a bottom plan view of one of the blocks of the FIG. 1 invention form.
Figure 4:
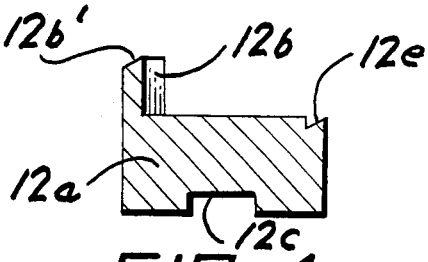
FIG. 4 is a view in vertical section, taken at line 4—4 on FIG. 1 and looking in the direction of the arrows, detailing a single block.
Figure 5:
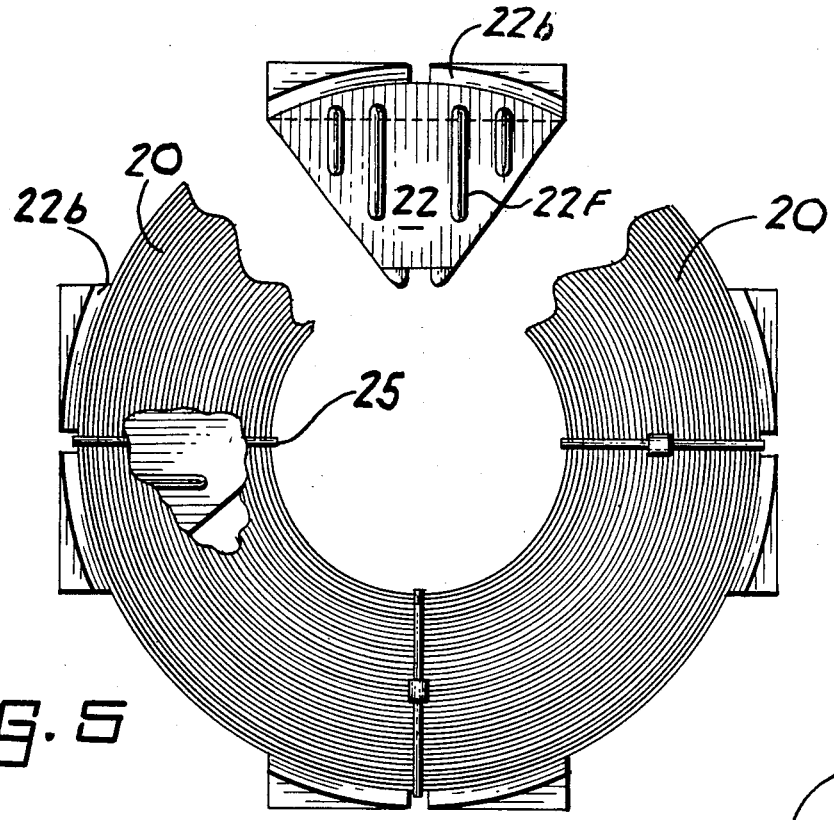
FIG. 5 is a plan view, partly fragmentary, showing another form of material handling arrangement in accordance with the teachings of the invention in a use condition.
Figure 7:
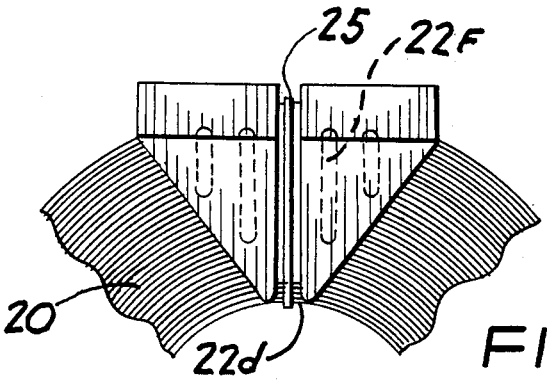
FIG. 7 is a bottom plan view of one of the blocks of the FIG. 5 invention form; and, FIG. 8 is a view in vertical section, taken at line 8—8 on FIG. 5 and looking in the direction of the arrows, detailing a single block.
Figure 8:
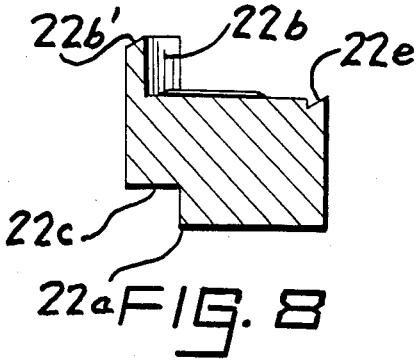
Figure 6:
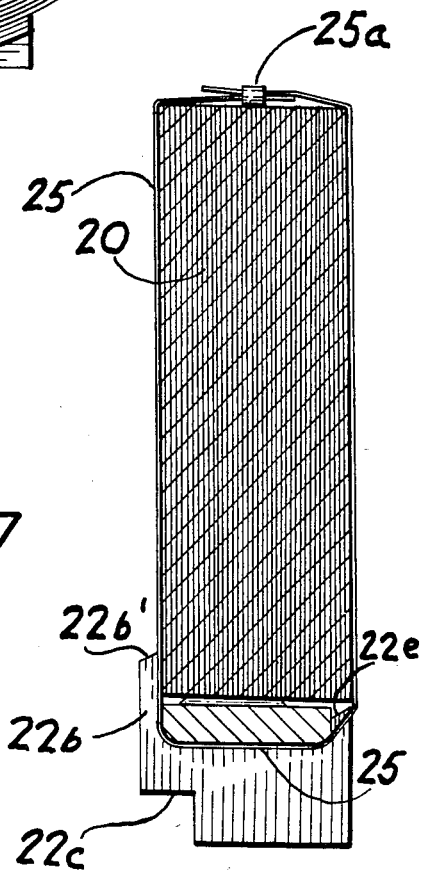
FIG. 6 is a view in vertical section, taken at line 6—6 on FIG. 5 and looking in the direction of the arrows, further illustrating the invention form of such figure.

More specifically, and with particular reference to FIG. 4, each block 12 presents a body or base portion **12*a*, the top surface of which receives stock 10; an arcuate upstanding rim 12*b*, against which the stock 10 abuts in a confined relationship when assembled for transporting; and, a cut-out portion 12*c* proportioned and adapted to receive a fork of a conventional lift truck (also see FIG. 3**).

Figure 2:
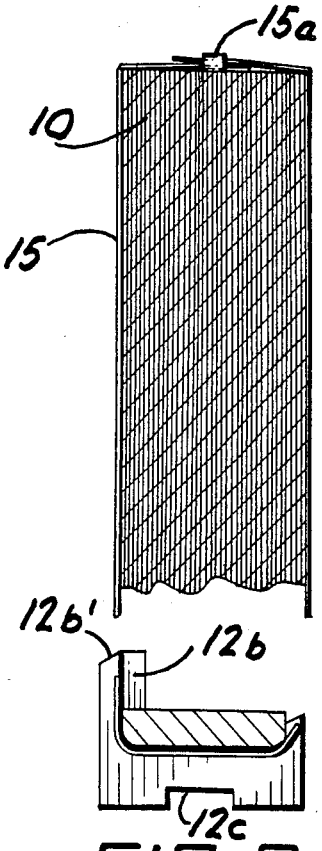
FIG. 2 is a view in vertical section, taken at line 2—2 on FIG. 1 and looking in the direction of the arrows, further illustrating the invention form of such figure.

Each block 12 includes a recess or slotted portion **12*d* which extends transversely of and above the cut-out portion 12*c*, also extending through the upstanding rim 12*b* (evident in FIGS. 1, 2 and 3). The arrangement presented by each block 12 is further defined by a groove 12*e*, angling downwardly and inwardly and serving to mate with an angled cut 12*b*' on the upstanding rim 12*b* of another block 12** when pairs of blocks are inverted with respect to each other for stacking/storage purposes.

In any event, when used, two pairs of opposing blocks 12 are arranged to receive stock 10, i.e. so that the cut-out portions 12 of each pair can receive the forks of a lift truck. The stock 10 abuts the upstanding rim **12*b* of each block 12, and banding 15, typically metal, is secured around each block 12, passing through recess 12*d* (see FIGS. 2 and 3), where a fastener 15*a* serves to secure and tighten the banding 15**. Thus, in contrast to wooden pallets, a durable, lightweight and readily stacked block arrangement is provided for convenient material handling.

FIGS. 5 to 8, inclusive, show another form of the invention, in this instance being for use with a conventional sheet edge lifter. Blocks 22 are generally similar to the blocks 12 described above, but instead of a cut-out portion **12*c* for a fork of a lift truck, a cut-out portion 22*c* is provided to receive the sheet edge lifter, i.e. the latter bears against the horizontal or upper surface thereof when in use. Another feature, ribs 22*f* on the top surface of base portion or body portion 22*a*, serve, among other needs, reinforcing purposes, and where such would be equally adaptable for use with the invention form of FIGS. 1 to 4**, inclusive.

Each block 22 also includes an upstanding rim **22*b*, a recess or slotted portion 22*d*, and a groove 22*e* cooperating with an angled cut 22*b*' in the upstanding rim 22*b* (when pairs of blocks 22 are inverted for stacking/storage) Banding 25, with associated fastener 25*a*, serves the same function as described for the banding 15-fastener 15*a* of the first discussed invention form, i.e. to secure stock 20** in the illustrated transporting condition.

From the preceding, it should be evident that the invention provides a superior approach to material handling than the commonly known pallet. The blocks of the instant arrangement afford, as stated, durability, lightweight, ease in positioning, and ready stacking, serving usefulness with either the forks of a lift truck or a sheet edge lifter.

The arrangement forms described above are susceptible to various changes within the spirit of the invention, including, by way of example, proportioning; choice of material; the number of and/or arrangement of ribs, if used; and, the like. Thus, the preceding should be considered illustrative and not as limiting the scope of the following claims.

I claim:

1. A material handling arrangement comprising a grouping of spaced apart pairs of opposing independent blocks selectively and directly disposed beneath cylindrical material in a supporting relationship, each of said blocks presenting a cut-out area adapted to receive a lifting mechanism, and securing means encircling each block and a portion of said material, where each of said blocks includes an upstanding circumferential rim against which said cylindrical material abuts, where each of said blocks has a bottom portion, where said cut-out area is in said bottom portion and generally parallel to that in an opposing block for receiving said lifting mechanism in opposing blocks, and where a recess is provided in said bottom portion to receive said securing means.

2. The material handling arrangement of claim 1 wherein said recess extends above said cut-out area.

3. A material handling arrangement comprising a grouping of spaced apart blocks selectively disposed beneath material in a supporting relationship, each of said blocks presenting a cut-out area adapted to receive a lifting mechanism, and securing means encircling each block and a portion of said material, where each of said blocks includes an upstanding rim against which said material abuts, each rim presenting an angling upper edge, where each of said blocks has an upper surface including an inwardly and downwardly extending groove along its inner periphery, and where said inwardly and downwardly extending groove is cooperable with said angling upper edge of an adjacent block in a stacked relationship.

4. A material handling arrangement comprising a grouping of spaced apart blocks selectively disposed beneath material in a supporting relationship, each of said blocks presenting a cut-out area adapted to receive a lifting mechanism, and securing means encircling each block and a portion of said material, where each of said blocks includes an upstanding rim against which said material abuts and a material receiving bottom portion, and where said upstanding rim and said material receiving bottom portion each include portions in cooperable selective engagement with complementary shaped portions of an adjacent block in a stacked relationship.

5. A material handling arrangement comprising a grouping of spaced apart pairs of opposing independent blocks selectively and directly disposed beneath cylindrical material in a supporting relationship, each of said blocks presenting a cut-out area adapted to receive a lifting mechanism, and securing means encircling each block and a portion of said material, where each of said blocks includes an upstanding circumferential rim against which said cylindrical material abuts, where each of said blocks has a material receiving bottom portion, where said cut-out area is in said material receiving bottom portion and generally parallel to that in an opposing block for receiving said lifting mechanism in opposing blocks, where a recess is provided in said material receiving bottom portion to receive said securing means, and where said upstanding rim and said material receiving bottom portion each include portions in cooperable selective engagement with complementary shaped portions of an adjacent block in a stacked relationship.

* * * * *